United States Patent [19]

Lindberg

[11] Patent Number: 4,520,597

[45] Date of Patent: Jun. 4, 1985

[54] GRINDING UNIT FOR INDUSTRIAL ROBOT AND AUTOMATIC MACHINES

[75] Inventor: Per-Olof Lindberg, Västerås, Sweden

[73] Assignee: ASEA Aktiebolag, Västerås, Sweden

[21] Appl. No.: 439,874

[22] Filed: Nov. 8, 1982

[30] Foreign Application Priority Data

Nov. 10, 1981 [SE] Sweden ..... 8106654

[51] Int. Cl.[3] ..... B24B 5/00

[52] U.S. Cl. ..... 51/134.5 R; 51/126

[58] Field of Search ..... 51/134.5 R, 354, 126, 51/170 T

[56] References Cited

U.S. PATENT DOCUMENTS

| | | | |
|---|---|---|---|
| 203,234 | 4/1878 | Wright et al. | 51/126 |
| 1,653,108 | 12/1927 | Koenig | 51/170 T |
| 2,722,784 | 11/1955 | Thiel | 51/126 |
| 3,151,424 | 10/1964 | Ranelli | 51/216 R |

*Primary Examiner*—James L. Jones, Jr.

*Attorney, Agent, or Firm*—Watson, Cole, Grindle & Watson

[57] ABSTRACT

A grinding unit especially adapted for use for grinding with a robot and in automatic machines. The unit is designed with a grinding wheel on an axially displaceable shaft, which is urged in a direction towards a surface to be ground by a spring. The grinding pressure is determined by this spring and the position of the grinding wheel is determined by the level of the grinding surface. The mass of the parts which are displaced under the influence of the grinding pressure can be made small. Only the grinding wheel, the shaft and a member, which is directly connected to said shaft, are displaced. Therefore, the grinding pressure is influenced only to an insignificant extent when changing the orientation of the grinding unit.

15 Claims, 2 Drawing Figures

GRINDING UNIT FOR INDUSTRIAL ROBOT AND AUTOMATIC MACHINES

TECHNICAL FIELD

When using a grinding unit with a robot or an automatic machine, variations in the level of the surface to be ground can cause problems. When programming the movement pattern of a robot, a specimen of the product to be ground is used as the basis for the program. However, dimensional variations always occur, to which due allowance must be made in order to prevent overload of the robot, the grinding unit carried by the robot, or a grinding wheel of the unit. The wear during use of the grinding wheel must also be taken into consideration. Further, in many cases it is necessary to use a specified grinding pressure in order to obtain the desired grinding result.

DISCUSSION OF PRIOR ART

It is known to resiliently attach a grinding unit, with a drive motor and a grinding wheel, to a supporting robot arm. Provided that the grinding pressure is high and that large variations in the grinding pressure can be tolerated, the known solution is satisfactory. If a low and/or uniform grinding pressure is required, the known resilient attachment of the entire grinding unit to the robot arm is not useful. The position of the grinding unit will influence the grinding pressure to too great an extent. When a low grinding pressure is desired, the known arrangement cannot be used at all. If a grinding pressure of 10 kg is desired and if the grinding unit weighs more than 10 kg, it is obvious that a grinding operation which requires an inversion of the grinding unit during that grinding operation is not possible.

One object of the invention is to provide a grinding unit which is capable of operating with a relatively low grinding pressure, which gives a small change of the grinding pressure upon changed orientation of the grinding unit, which is insensitive to moderate dimensional variations of the product to be ground, i.e., the position of the surface to be ground, and in which the wear of the grinding wheel insignificantly affects the grinding pressure. A further object of the invention is to provide a grinding unit, the position of which can be adjusted relative to a robot arm so that the grinding surface of the grinding wheel, after grinding of a certain number of objects, can be adjusted in the correct position in relation to a reference plane in order to compensate for the wear. This adjusting can then be included in the working program of the robot.

BRIEF STATEMENT OF INVENTION

A grinding unit according to the invention comprises an axially displaceable grinding wheel shaft, which is influenced by a spring in a direction towards a limit position which is determined by a stop member. The pressure of the grinding wheel is determined by the force of this spring. According to the invention, the grinding unit comprises a holder by which the grinding unit is attached to a robot arm. The holder supports a drive motor. A housing having an axial guide means for a grinding wheel shaft is mounted on the motor shaft. The holder includes a radial support bearing for this housing. The part of the grinding wheel shaft which is included in the axial guide means suitably has a polygonal cross-section. A square cross-section is convenient. The shaft runs in a guide means, having a cross-section adapted to the shaft, in the housing. Linear ball or roller bearings can be used to reduce the friction.

To make it possible to compensate for the wear of the grinding wheel, the holder for the grinding unit can be designed with a linear guide means, permitting displacement of the main portion of the grinding unit parallel to the grinding wheel shaft relative to an attachment by which it is joined to the robot arm. The main portion of the holder is provided with a locking device which permits locking of this portion relative to the noted attachment and thus relative to the supporting robot arm. The locking device can consist of a piston-in-cylinder unit which influences a stop member.

BRIEF DESCRIPTION OF DRAWINGS

One embodiment of grinding unit in accordance with the invention will be described in greater detail, by way of example, with reference to the accompanying drawing, in which.

DESCRIPTION OF PREFERRED EMBODIMENT

Figure 1:
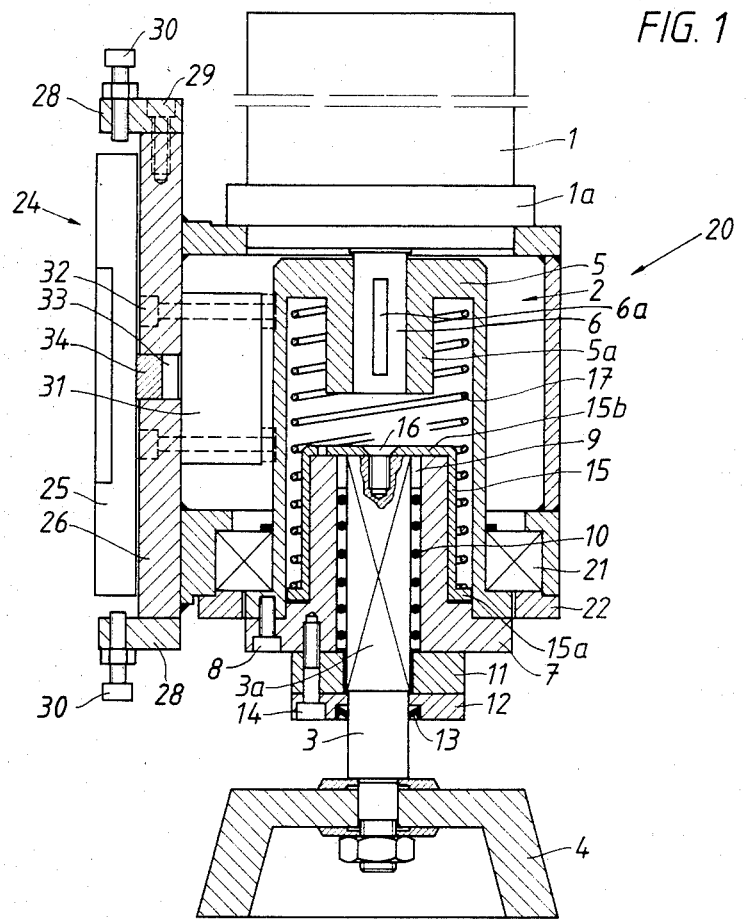
FIG. 1 is a cross-sectional view through the grinding unit taken on the line A—A of FIG. 2.

In the drawing, 1 designates a drive motor and 2 a unit with an axially displaceable shaft 3 which supports a cup-shaped grinding wheel 4. The unit 2 comprises a cylindrical housing 5 which is connected via a key 6*a* to the drive shaft 6 of the motor 1. In the lower part of the housing 5 there is a sleeve 7 serving as an axial guide for the grinding wheel shaft 3. The sleeve 7 is fixedly connected to the housing 5 by bolts 8 (only one of which is shown in FIG. 1). The guide sleeve 7 includes a guide channel 9 of square cross-section which receives an inner portion 3*a* of the wheel shaft 3, the inner portion 3*a* also having a square cross-section. Between the walls of the guide channel 9 and the inner portion 3*a* of the wheel shaft, linear roller bearings 10 are located. At the outer end of the sleeve 7 there is a plate 11, which fixes the roller bearings 10 in place in the channel 9, and a plate 12, provided with a sealing ring 13. The plates 11, 12 are clamped onto the sleeve 7 by bolts 14 (only one of which is shown). The inner end of the wheel shaft 3 is fixed to a hat-shaped sleeve 15 by a screw 16. The housing 5 includes a helical spring 17, which at one end rests against a radially projecting flange 15*a* of the sleeve 15. The wheel shaft 3, with the grinding wheel 4, is axially displaceable between the position shown in FIG. 1, where a top portion 15*b* of the sleeve is urged by the spring 17 against the inner end surface of the sleeve 7, and a position in which the top portion 15*b* makes contact with a sleeve portion 5*a* of the housing 5 which surrounds the drive shaft 6. The spring 17 has a relatively low spring constant which must be considerably compressed to obtain the desired grinding pressure. In this way only a small change of the grinding pressure arises during a grinding operation as a result of the resilient mounting of the grinding wheel 4.

The motor 1 and the unit 2 with the axially displaceable wheel shaft 3 are arranged in a common holder 20. A flange 1*a* of the motor is attached to the holder 20 by bolts 23. At its outer end, the housing 5 of the unit 2 is journalled in a radial support bearing 21, the radial outer part of which is fixed in the holder 20 by a ring 22.

Figure 2:
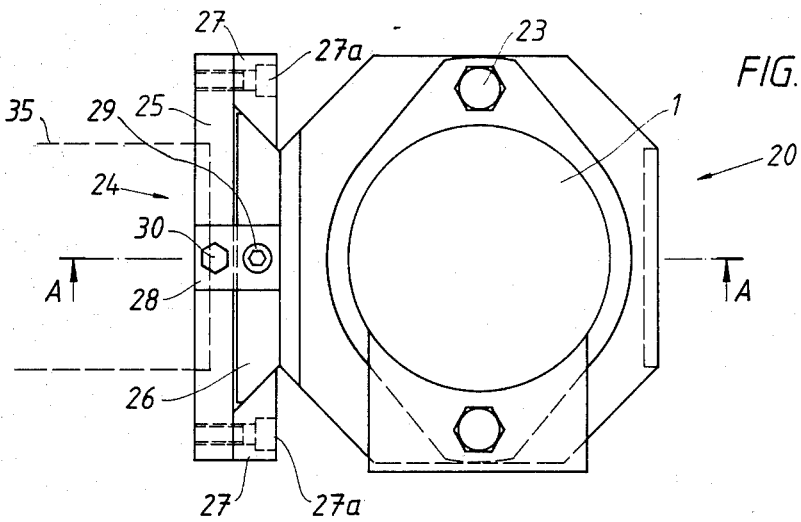
FIG. 2 is an end view of the grinding unit.

The holder 20 is provided with an attachment 24. This includes a plate 25 designed to be fixed in any convenient manner to a robot arm (shown in dashed lines at 35 in FIG. 2), and a wedge-shaped plate 26 which supports the holder 20. Two bars 27 are connected to the plate 25 by bolts 27*a* so as to obtain a dovetailed guide slot in which the plate 26 can move. Stop members 28 are attached to the ends of the plate 26 by bolts 29 and are each provided with adjustable stop screws 30. A compressed-air piston-in-cylinder unit 31 is attached to the plate 26 by bolts 32. The piston rod 33 of the piston-in-cylinder unit 31 is faced with a block 34 of friction material. By activating the unit 31, the block 34 is pressed against the plate 25 to lock the plates 25, 26 in a specified position in relation to each other. By controlling the position of the grinding unit relative to the robot arm 35 between the stop members 28 using the unit 31, compensation can be made for the wear of the grinding wheel 4. To make this adjustment, the wheel 4 is moved towards a reference plane, the pressure medium in the unit 31 is de-pressurized, whereby the frictional engagement between the plates 25 and 26 of the holder 24 is released so that the grinding wheel can be adjusted in the proper position in relation to the reference plane. After the adjustment, the cylinder 31 is re-pressurized to relock the plates 25 and 26 in the new position required.

Various changes can be made to the embodiment described. Thus, for example, any polygonal cross-section can be used for the inner portion 3*a* of the wheel shaft 3, and the grinding wheel 4 can be other than cup-shaped. These, and other changes apparent to one skilled in the art, fall within the scope of the invention defined by the following claims.

What is claimed is:

1. A grinding unit which is attachable to a robot, said grinding unit comprising a holder, an adjustable attachment means connected to said holder for attaching said holder to a robot, a housing having opposite ends, said housing being rotatably journalled at one of its ends in said holder, an axial guide sleeve means mounted at the journalled end of said housing, a grinding wheel shaft non-rotatably mounted relative to said housing but axially movably mounted between a first limit position and a second limit position, said grinding wheel shaft being capable of mounting a grinding wheel, a stop means defining said first limit position, spring means urging said grinding wheel shaft toward said first limit position, and a drive motor mounted on said holder, said drive motor including a drive shaft connected to said housing to simultaneously rotate said housing and said grinding wheel shaft.

2. A grinding unit according to claim 1, wherein said axial guide sleeve means has a guide channel therein having a polygonal cross section, wherein said grinding wheel shaft has an inner portion which has a corresponding polygonal cross section, and wherein the inner portion of said grinding wheel shaft fits within the guide channel in said axial guide sleeve, such that rotation of said axial guide sleeve causes rotation of said grinding wheel shaft.

3. A grinding unit according to claim 2, wherein said corresponding polygonal cross sections are square.

4. A grinding unit according to claim 2, wherein a linear ball guiding means is located in the guide channel in said axial guide sleeve means so as to enable axial movement of the inner end of said grinding wheel shaft therewithin.

5. A grinding unit according to claim 2, wherein said a linear roller guiding means is located in the guide channel in said axial guide sleeve means so as to enable axial movement of the inner end of said grinding wheel shaft therewithin.

6. A grinding unit according to claim 1, wherein said adjustable attachment means includes elements which enable said holder to move said housing with respect to a robot to which said attachment means is attached, said movement being along a line parallel with the axis of said grinding wheel shaft.

7. A grinding unit according to claim 6, wherein said adjustable attachment means includes a locking device for locking the positioning of said housing with respect to a robot to which said attachment means is attached.

8. A grinding unit according to claim 7, wherein said locking device comprises a hydraulic piston/cylinder unit.

9. A grinding unit according to claim 8, wherein the piston of said hydraulic piston/cylinder unit includes a piston shaft mounting a friction block.

10. A grinding unit according to claim 9, wherein the elements of said adjustable attachment means include a plate attachable to a robot, parallel bars connected to said plate, said parallel bars forming a linear, wedge-shaped slot therebetween, and a wedge-shaped plate connected to said holder, said wedge-shaped plate being slidable along said linear, wedge-shaped slot.

11. A grinding wheel according to claim 10, wherein said hydraulic piston/cylinder unit is mounted with said wedge-shaped plate, and wherein the friction block on said piston shaft is abuttable against said flat plate attachable to a robot.

12. A grinding unit which is attachable to a robot, said grinding unit comprising a holder, said holder including an annular support bearing, an adjustable attachment means connected to said holder for attaching said holder to a robot, a generally cylindrical housing rotatably mounted in said holder, said generally cylindrical housing having a first end, a second end and a chamber therein which communicates with said second end and extends towards its first end, the second end of said generally cylindrical housing being rotatable within the annular support bearing of said housing, a generally hat-shaped axial guide sleeve connected to said generally cylindrical housing so as to cover the chamber mouth at the second end thereof and extend into the chamber therein, said generally hat-shaped axial guide sleeve forming a stop surface on the surface thereof facing said chamber and including a guide channel extending therethrough, an abutment sleeve located within said chamber and movable between a second limit position where it is in contact with the first end of said housing and a first limit position where it is in contact with the stop surface of said generally hat-shaped axial guide sleeve, a spring means located with said chamber between the first end of said generally cylindrical housing and said abutment sleeve to urge said abutment sleeve to its first limit position, a grinding wheel shaft having an inner end located within the guide channel in said generally hat-shaped axial guide sleeve, said grinding wheel shaft being rotatable with said generally hat-shaped axial guide sleeve but axially movable along the guide channel therein, the inner end of said grinding wheel shaft being connected to said abutment sleeve, and a drive motor mounted on said holder, said drive motor including a drive shaft which is connected to the first end of said generally cylindrical housing to simultaneously rotate said housing, said axial guide sleeve, said abutment sleeve, said spring means, and said grinding wheel shaft.

13. A grinding unit according to claim 12, wherein said abutment sleeve is generally hat-shaped.

14. A grinding unit according to claim 12, wherein the guide channel in said generally hat-shaped axial guide sleeve and the inner end of said grinding wheel shaft have corresponding cross sectional shapes.

15. A grinding unit according to claim 12, wherein said adjustable attachment means includes elements which enable said holder to move said housing with respect to a robot to which said attachment means is attached, said movement being along a line parallel with the axis of said grinding wheel shaft.

* * * * *